US005508007A

United States Patent [19]

Vidal et al.

[11] Patent Number: 5,508,007

[45] Date of Patent: Apr. 16, 1996

[54] CIRCULATING FLUIDIZED BED REACTOR INCLUDING EXTERNAL HEAT EXCHANGERS FED BY INTERNAL RECIRCULATION

[75] Inventors: Jean Vidal, Ville D'Avray; Jean-Xavier Morin, Neuville Aux Bois; Jean-Paul Tessier, Paris, all of France

[73] Assignee: Societe Anonyme Dite: Stein Industrie, Velizy-Villacoublay, France

[21] Appl. No.: 344,633

[22] Filed: Nov. 17, 1994

Related U.S. Application Data

[63] Continuation of Ser. No. 49,855, Apr. 20, 1993, abandoned.

[30] Foreign Application Priority Data

Apr. 27, 1992 [FR] France ..... 92 05165

[51] Int. Cl.[6] ..... B01J 8/18; F27B 15/14; F27B 15/08

[52] U.S. Cl. ..... 422/141; 422/145; 422/146; 422/147; 165/104.16; 122/40; 110/245; 431/7; 431/170

[58] Field of Search ..... 422/146, 147, 422/141, 145; 165/104.16; 122/40; 110/245; 431/7, 170

[56] References Cited

U.S. PATENT DOCUMENTS

| | | | |
|---|---|---|---|
| 4,594,967 | 6/1986 | Wolowodiuk | 165/104.16 X |
| 4,896,631 | 1/1990 | Holm et al. | 122/40 |
| 5,069,170 | 12/1991 | Gorzegno et al. | 122/4 |
| 5,069,171 | 12/1991 | Hasen et al. | 122/4 |
| 5,120,691 | 6/1992 | Pontier | 422/146 X |
| 5,133,943 | 7/1992 | Abdulally | 422/145 |
| 5,269,263 | 12/1993 | Garcia-Mallol | 122/4 |
| 5,316,736 | 5/1994 | Vidal et al. | 422/145 |
| 5,332,553 | 7/1994 | Hyppanen | 422/147 |
| 5,341,766 | 8/1994 | Hyppanen | 122/4 |

FOREIGN PATENT DOCUMENTS

| | | |
|---|---|---|
| 0211483 | 2/1987 | European Pat. Off. . |
| 0332360 | 9/1989 | European Pat. Off. . |
| 0453373 | 10/1991 | European Pat. Off. . |

*Primary Examiner*—Timothy M. McMahon
*Assistant Examiner*—N. Bhat
*Attorney, Agent, or Firm*—Sughrue, Mion, Zinn, Macpeak & Seas

[57] ABSTRACT

A circulating fluidized bed reactor includes a lower zone having a fluidization grid, primary and secondary air injection inlets, and fuel feed inlets, an upper zone, internal bubbling beds at the top of the lower zone collecting solid matter from recirculation internal to the reactor and delivering a fraction thereof to external bubbling bed heat exchangers close coupled with the walls of the reactor level with the internal beds. The external heat exchangers reject the solid matter into the lower zone after exchanging heat with an external fluid. The reactor is simple in structure and benefits from the advantages of bubbling external beds while maintaining conventional design in the lower zone.

10 Claims, 11 Drawing Sheets

CIRCULATING FLUIDIZED BED REACTOR INCLUDING EXTERNAL HEAT EXCHANGERS FED BY INTERNAL RECIRCULATION

This is a continuation of application No. 08/049,855 filed Apr. 20, 1993, now abandoned.

Circulating fluidized bed reactors are commonly used at present in fossil fuel power stations for greater and greater powers. The greatest power presently in service is 150 megawatts electrical (MWe).

BACKGROUND OF THE INVENTION

Three types of circulating fluidized bed exist which differ in the way in which reactor temperature is regulated, which temperature must be kept constant at a value close to 850° C. in order to ensure effective desulfurization of the flue gases:.

the first type has panel heat exchangers installed inside the reactor (METALL-GESELLSCHAFT's French patent No. 2 323 101) and to maintain said temperature it adjusts the density of solid matter either by regulating primary and secondary air flow rates, or else by recycling combustion gases at avariable rate; however, as the power of the installation increases, it becomes necessary to extend the installation of said panel heat exchangers further and further down inside the reactor, thereby correspondingly increasing the risks of erosion;

the second type has external heat exchangers disposed on the external recirculation line for solid matter picked up at the outlet from the reactor by means of a separator (METALLGESELLSCHAFT's French patent No. 2 353 332); such external heat exchangers being installed at a distance from the reactor and thus requiring linking ductwork between the cyclone separator and the external heat exchanger, and between the external heat exchanger and the reactor, together with the necessary slopes and expansion joints; as the power of a reactor is increased, the heat exchange power of the tube walls of the reactor generally does not increase proportionally because of the limitation in the height of the reactor, and thus the power of the external heat exchangers increases more quickly, as does the number of such heat exchangers and their dimensions; this makes installation thereof even more difficult or even impossible and provides a limit at present on the electrical power that can be considered for use with this technology; and the third type is that described by STEIN INDUSTRIE in its European patent application No. 91 401 041.8, and it has a decrease in the fluidization gas velocity inside the reactor on going past a bubbling bed installed at an intermediate level of the reactor; this velocity decrease is obtained by a large and quantified change in the cross-section of the reactor (ratio lying in the range 1.2 to 2) for the purpose of improving combustion by means of an increase in the amount of solid matter recirculated to the lower portion of the reactor; because a heat exchanger exists in said internal bubbling bed, this third type of reactor makes it possible to reduce the heat exchange power compared with that of the internal panels of the first type of circulating fluidized bed or with that of the external heat exchangers of the second type of circulating fluidized bed; however, in general, it does not make it possible to omit them in high power units.

SUMMARY OF THE INVENTION

The present invention relates to a circulating fluidized bed reactor including a lower zone under circulating fluidized bed conditions and provided with a fluidization grid, primary air injection means beneath the grid, and secondary air injection means above the grid, the walls of the reactor surrounding said lower zone being provided with cooling tubes, an upper zone operating under circulating fluidized bed conditions being surrounded with reactor walls provided with cooling tubes, means for admitting fuel into the lower zone, at least one external heat exchanger comprising a bubbling bed disposed against a wall of the reactor so as to be close coupled therewith, said bed being fed with solid matter coming from the reactor, and delivering said solid matter into the lower zone after exchanging heat with an external fluid to be heated.

One disposition of a heat exchanger attached to the reactor in a close coupled relationship therewith is described in Document EP-A-444926, which corresponds to a variant of the second type of reactor.

In the reactor of that variant, the external heat exchanger is fed via a siphon preceded by a cyclone that separates the solid matter coming from the top of the upper zone of the reactor. The external heat exchanger placed beneath the cyclone and the siphon is secured to the bottom portion of the lower zone and that has the drawback of preventing secondary air being injected through one of the main walls of the reactor, thus limiting the distance between the front and rear walls of the reactor and consequently limiting its power for a given length of rear wall.

The reactor of the invention does not have that drawback and includes at least one internal bubbling bed installed in the top portion of the lower zone on one or more walls of the reactor and serving to collect firstly the solid matter falling along the walls of the upper zone and secondly the solid matter coming from the decrease in the velocity of the fluidization gases on going past the internal bubbling beds, the ratio of the right cross-section of the upper zone divided by the right cross-section of the lower zone level with the internal bed(s) lying in the range 1.05 to 2, and the external heat exchanger(s) is/are disposed above the secondary air inlets, and is/are fed with solid matter from the internal bubbling bed(s), the overflow of solid matter from said bed(s) falling down into the lower zone.

In addition, by its design, the reactor of the invention may easily be limited in height.

BRIEF DESCRIPTION OF THE DRAWINGS

The present invention is now described in greater detail with reference to a particular embodiment given by way of non-limiting example and shown in the accompanying drawings.

MORE DETAILED DESCRIPTION

Figure 1:
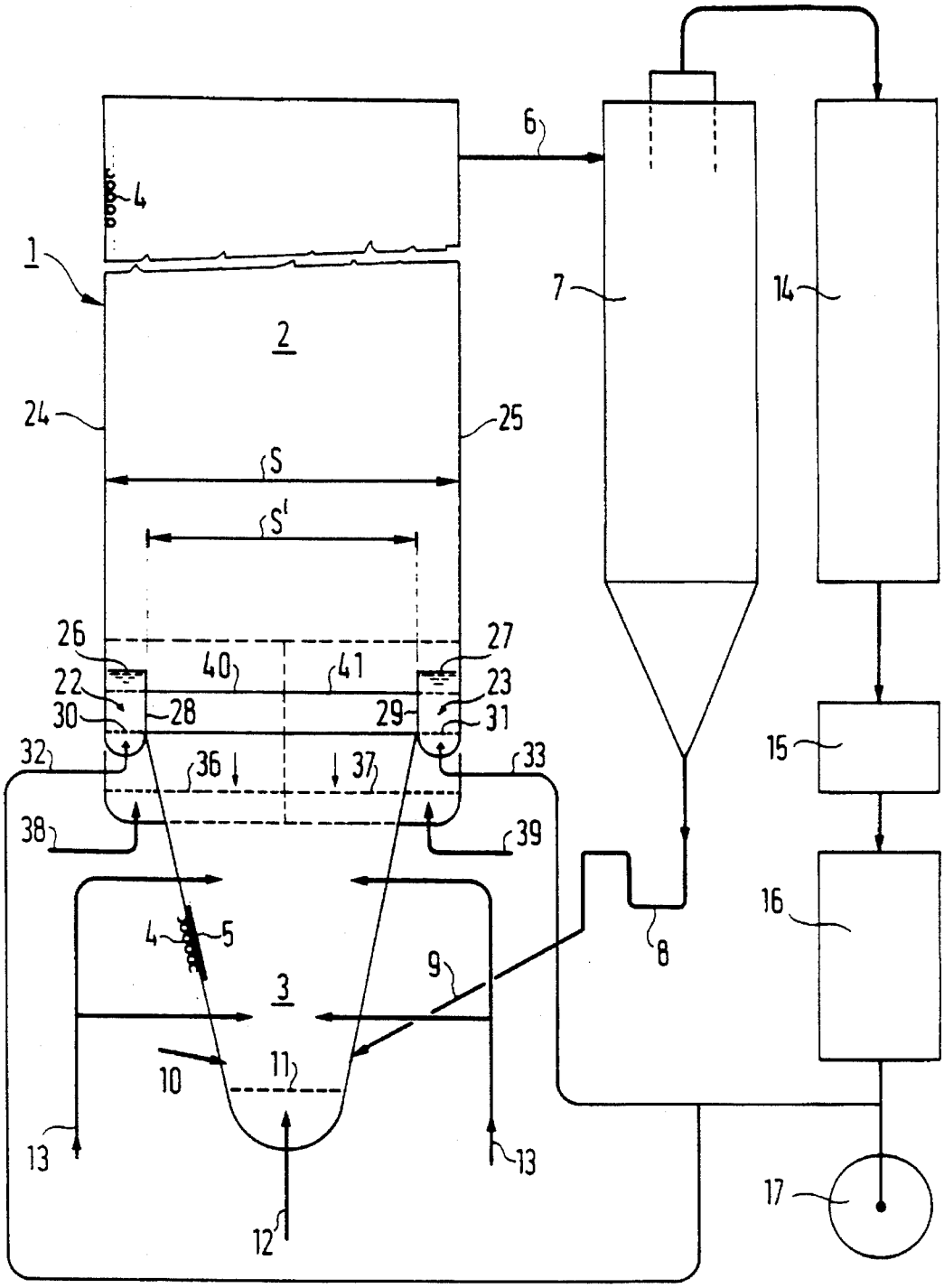
FIG. 1 is a diagrammatic front view of a reactor of the invention.

The circulating fluidized bed reactor of the invention for fossil fuel combustion is shown in FIGS. 1 to 6. Firstly, it comprises in conventional manner:

a tubular envelope 1 divided into two zones: an upper zone 2 in which tubes 4 are internally apparent and serve to cool solid matter and gases, and a lower zone 3 in which the tubes 4 are covered with refractory material 5 to protect them from erosion;

a duct 6 situated at the top of the upper zone 2 for directing gases charged with solid matter to a cyclone 7 where separation takes place, the collected solid matter being recycled to the lower zone 3 of the reactor by means of a duct 9 and after they have passed through a siphon 8;

one or more fuel inlets 10;

a fluidization grid 11 through which primary air is injected via an inlet 12;

a plurality of secondary air inlets 13 on one or more levels in the lower portion 3 of the reactor;

recovery heat exchangers in an enclosure 14 through which the gas from the cyclone 7 passes; and air heaters 15, a dust filter 16, and a chimney 17.

Figure 2:
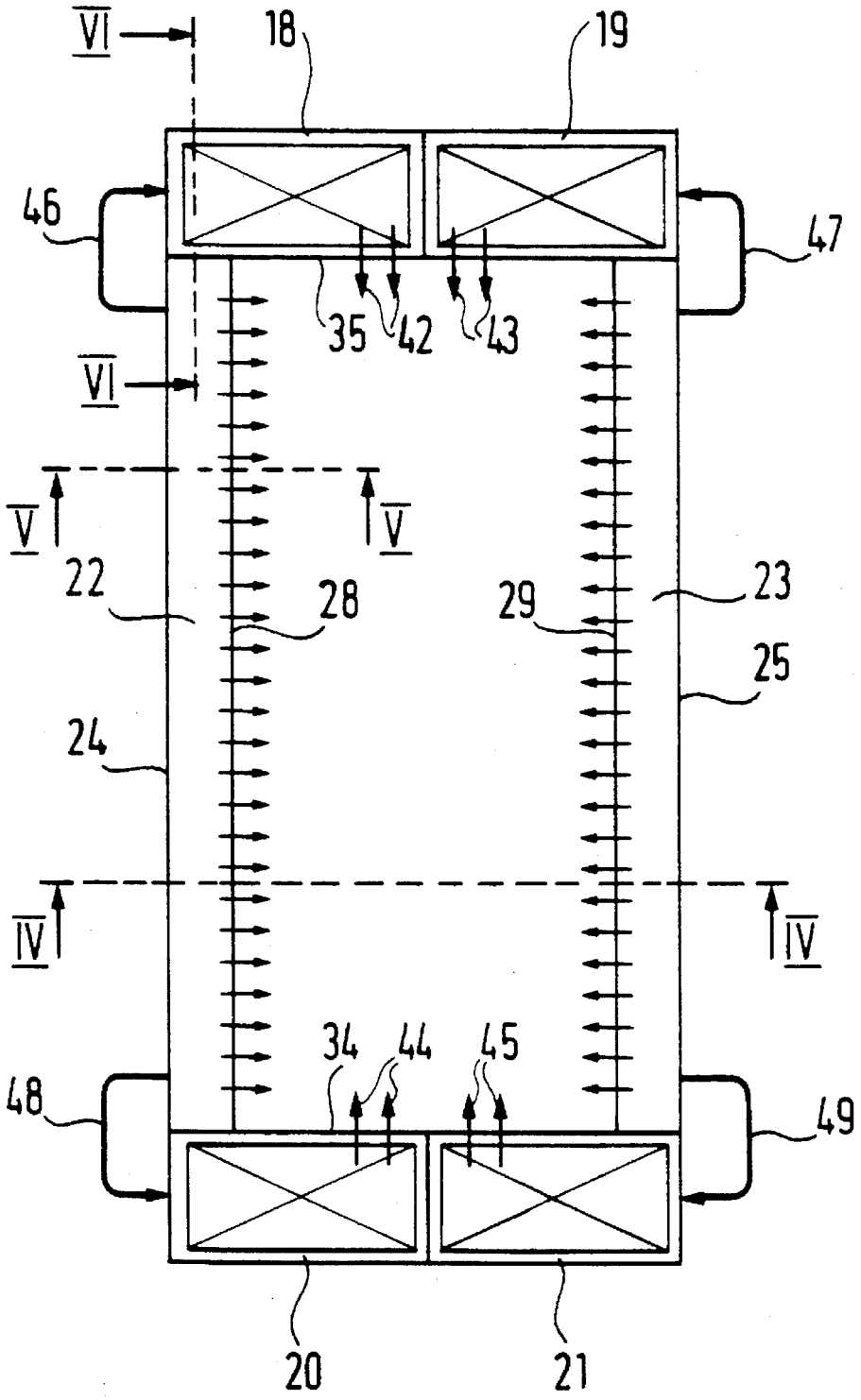
FIG. 2 is a diagrammatic plan view of the reactor of FIG. 1.
Figure 3:
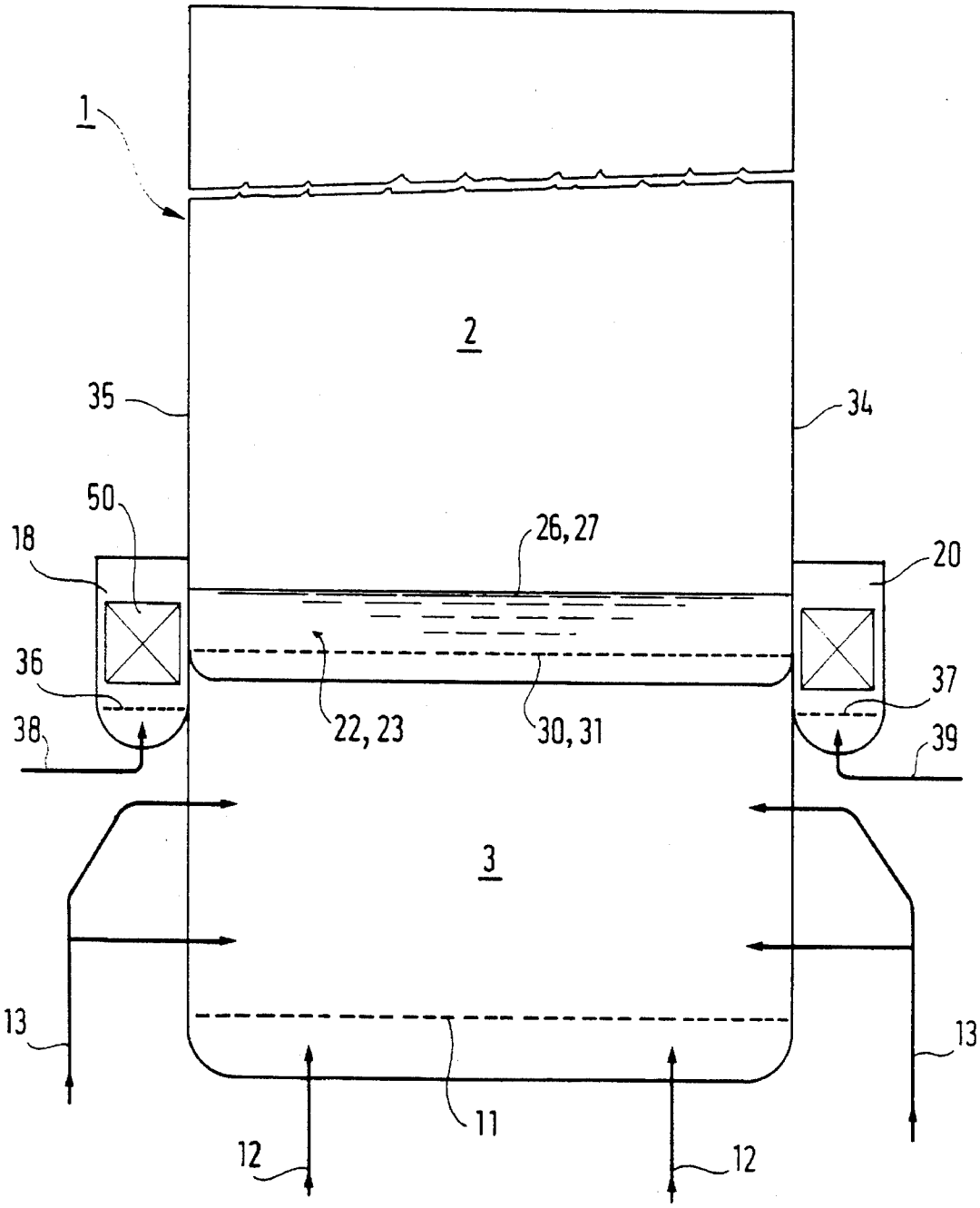
FIG. 3 is a diagrammatic side view of the reactor of FIG. 1.
Figure 4:
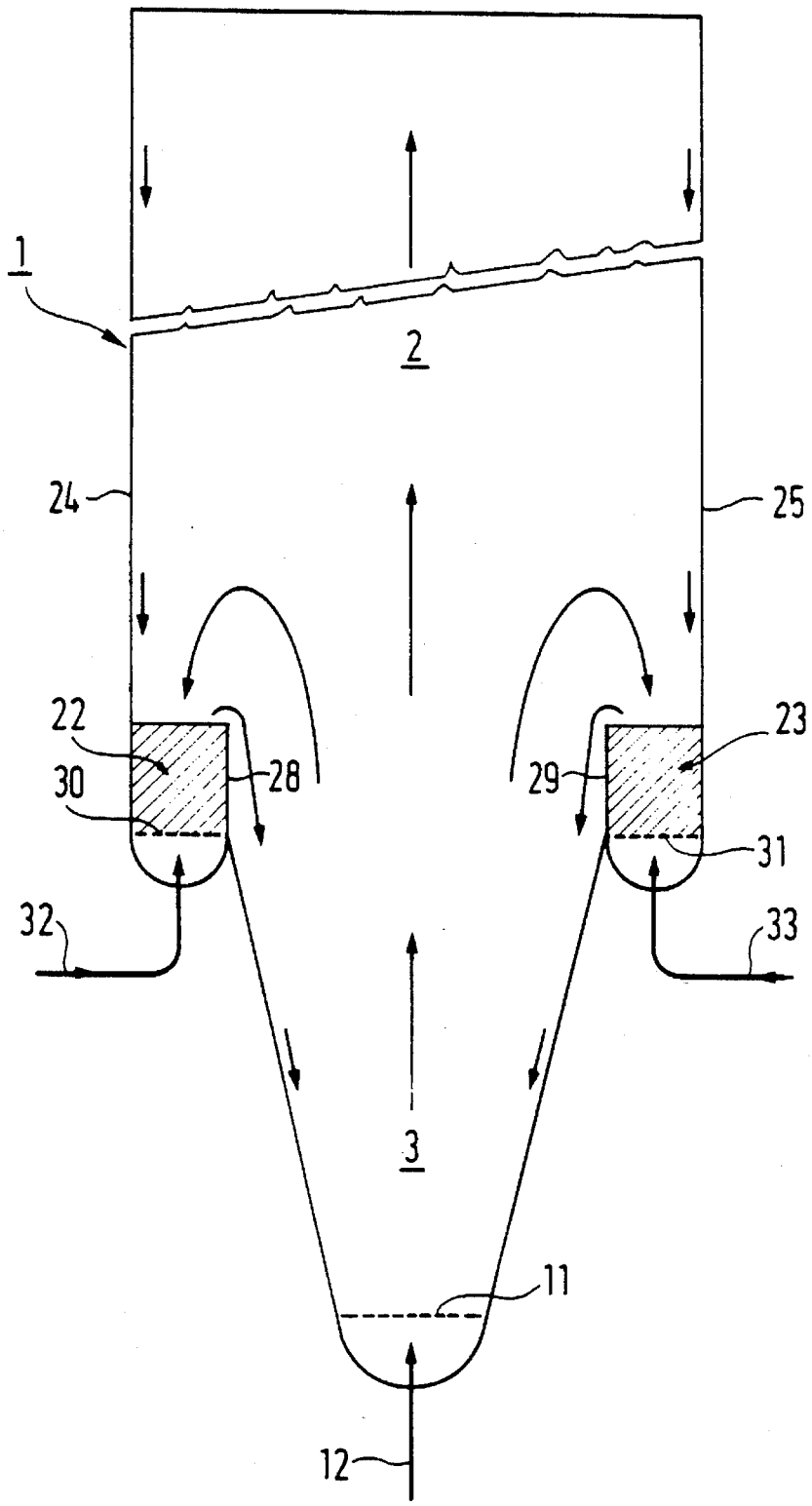
FIG. 4 is a diagrammatic vertical view of the FIG. 1 reactor, on IV—IV of FIG. 2.
Figure 5:
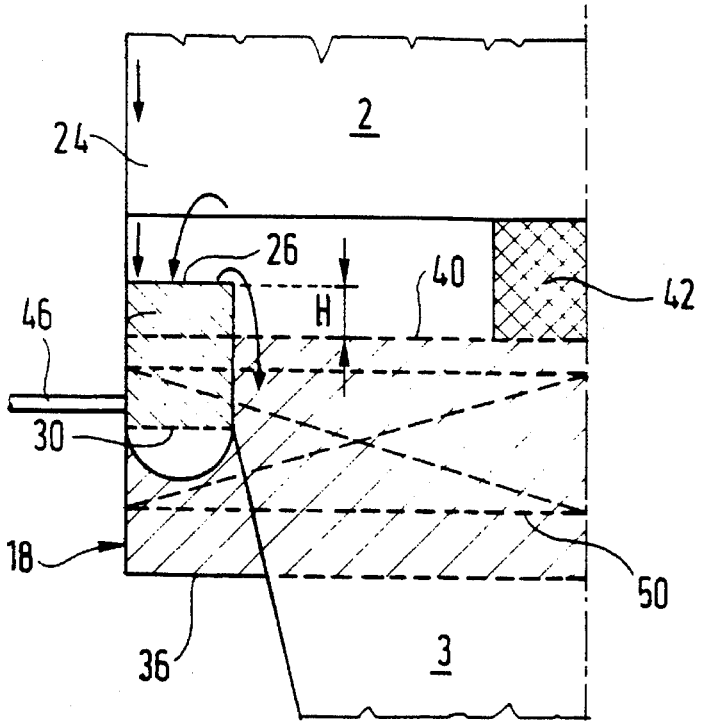
FIG. 5 is a fragmentary and enlarged diagrammatic view of the FIG. 1 reactor on V—V of FIG. 2.
Figure 6:
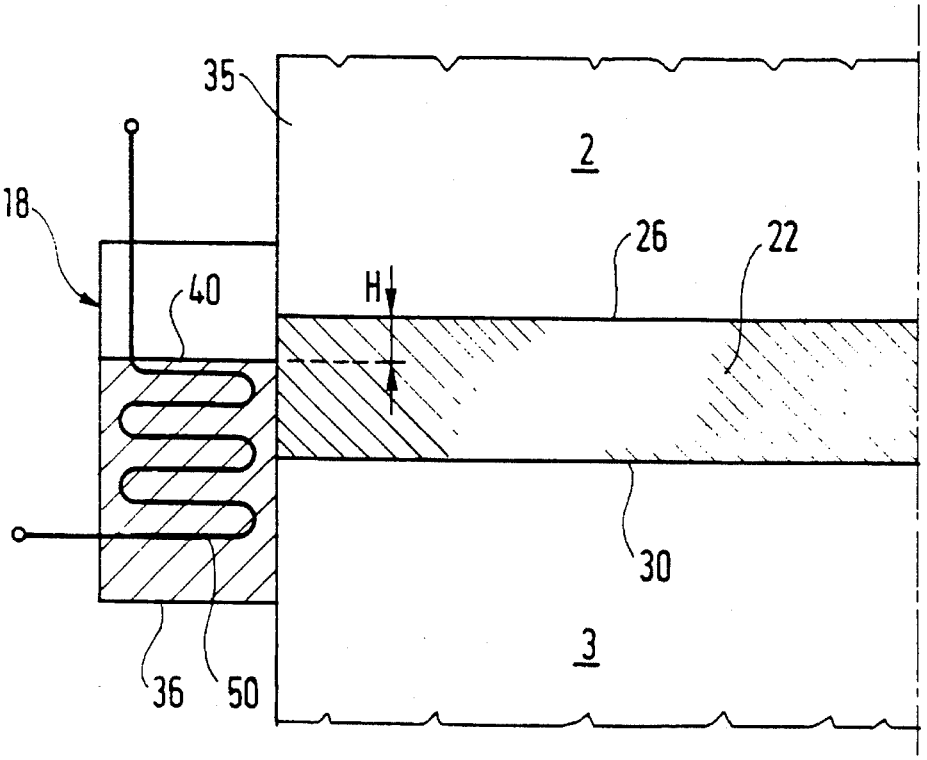
FIG. 6 is another fragmentary vertical diagrammatic view of the FIG. 1 reactor, on VI—VI of FIG. 2.

The novel characteristic of this reactor resides in the external heat exchangers that participate in cooling the fluidized solid matter moving in the gases and that operate under the following conditions:

a) The solid matter that pass through these external heat exchangers 18, 19, 20, and 21 are collected from the internal recirculation at an intermediate level of the reactor, at the top of the lower zone and not from the external recirculation of solid matter taken by the separator 7 installed on the outlet from the reactor.

b) As shown in FIG. 4, two internal bubbling beds 22 and 23 are installed at the top of the lower zone 3 for the purpose of taking these solid matter from an intermediate level of the reactor, thereby dividing the reactor into two portions: the upper zone 2 of cross-section S, and the lower zone 3 of varying cross-section, but in which the maximum cross-section S' on a level with the two internal bubbling beds 22 and 23 is less than S. The quantity of solid matter taken depends on two factors:

the length of the walls against which the internal bubbling beds 22 and 23 are installed, and thus the length of the side walls 24 and 25 in the example shown in FIGS. 1, 2, 3, and 4; and the rapid decrease in fluidization gas velocity corresponding to the ratio S'/S of the reactor cross-sections, the velocities of the fluidization gases in these two cross-sections S and S' always lying in the range 2.5 meters per second (m/s) to 12 m/s used in a circulating fluidized bed. The internal bubbling beds 22 and 23 are at a level 26, 27 which is naturally regulated by solid matter overflowing and falling down towards the lower zone 3 of the reactor along the entire length of the internal walls 28 and 29 of the internal beds 22 and 23 (FIG. 2). They are normally fitted with fluidization grids 30 and 31, and with fluidization gas feeds 32 and 33.

c) In order to be fed with solid matter by the internal bubbling beds 22 and 23, the four external heat exchangers which are also bubbling beds 18, 19, 20, and 21 (FIG. 2) are installed adjacent to the front and rear walls 34 and 35 of the reactor. They are fitted with fluidization grids 36 and 37 and with fluidization air feeds 38 and 39. The levels 40 and 41 of the solid matter passing through them are also adjusted by overflow and by falling down towards the lower zone 3 of the reactor at 42, 43, 44, and 45 in the vicinity of the vertical planes between the external heat exchangers 20 and 21 or the heat exchangers 18 and 19 and a value below that of the levels 26 and 27 of the internal bubbling beds 22 and 23 so as to ensure that solid matter flow between the internal bubbling beds 22 and 23, the external heat exchangers 18, 19, 20, and 21, and the lower zone 3 of the reactor. The relative disposition of the internal bubbling bed 22, the external heat exchanger 18, and the inside of the reactor is shown in FIGS. 5 and 6:

The internal bubbling bed 22 is in communication with the inside of the reactor via its upper portion which receives the solid matter falling from the upper zone 2 of the reactor and which returns a fraction thereof by overflowing towards the lower zone 3 over the entire length of the overflow wall 28.

The external heat exchanger 18 installed against the rear wall 35 of the reactor is entirely separated from the reactor by said wall with the exception of a window 42 whose bottom level 40 adjusts the height of the bubbling bed in the external heat exchanger; the solid matter required for the operation of the heat exchanger 18 come from the internal bubbling bed 22 via the duct 46 and return to the lower zone 3 of the reactor by overflowing through the bottom portion of the window 42. The cross-section of the window 42 is also dimensioned to ensure ventilation through the external heat exchanger 18. Heat exchanger tubing 50 is to be found in the external heat exchanger (FIG. 6) for the purpose of providing a portion of reactor cooling. The driving force required to circulate solid matter between the internal bubbling bed and the external heat exchanger is the difference H between the levels 26 and 40 of the two bubbling beds 22 and 18 (FIGS. 5 and 6); the flow of solid matter going from the internal bubbling bed 22 to the external heat exchanger 18 travels via a fluidized duct 46 provided with mechanical adjustment means (of the needle valve type) or having air injection (in which case the flow of solid matter is controlled by the quantity of air injected). This duct 46 may follow a circuit outside the two bubbling beds or it may make use of an orifice through the dividing wall common to said two bubbling beds.

The relative disposition is the same between the internal bubbling bed 22, the external heat exchanger 20 and the inside of the reactor, or between the internal bubbling bed 23, the external heat exchangers 19 or 21, and the inside of the reactor, with the external heat exchangers 19, 20, and 21 being fed by means of ducts 47, 48, and 49 from the internal bubbling beds 22 and 23.

d) The internal bubbling beds 22 and 23 are dimensioned, taking account of several parameters:

Their width corresponds to the selected ratio S/S' between the two internal cross-sections of the reactor; this ratio is fixed so that the flow of solid matter falling into the internal bubbling beds 22 and 23 is greater than that which is going to be used in the external heat exchangers 18, 19, 20, and 21. Under such conditions, there is always a flow of solid matter falling towards the lower zone 3 of the reactor by overflowing from the internal bubbling beds 22 and 23, over the walls 28 and 29. This ratio S/S' of the reactor of the invention lies in the range 1.05 to 2.

Their height is calculated as a function of the flow of solid matter required for proper operation of the attached external heat exchangers 18, 19, 20, and 21, and also as a function of the difference in height H between the top levels of the internal bubbling beds 22 and 23 and of the bubbling beds of the external heat exchangers 18, 19, 20, and 21.

The fluidization gases for the internal bubbling beds 22 and 23 must be inert since these beds do not include any heat exchangers and it is necessary to avoid any risk of combustion of carbons since that could give rise to build-ups; consequently, the fluidization gases are combustion gases taken from the outlets of the dust filters 16and corresponding to an extremely small quantity of recycled gases.

e) The external heat exchangers 18, 19, 20, and 21 are attached to the front and rear walls 34 and 35 of the reactor and they are dimensioned as a function of the amount of heat exchange they are required to perform to ensure that the reactor operates at a given temperature which is generally chosen to be 850° C. in order to obtain the best possible desulfurization. As a result, the width and the height of these external heat exchangers 18, 19, 20, and 21 are considerably greater than the width and the height of the internal bubbling beds 22 and 23.

The reactor described above is thus finally fitted with two types of cooling surface:

walls of tubes in the upper zone 2 of the reactor where heat exchange is a function of the solid matter density that results from optimizing combustion parameters (primary and secondary air flow rates) and is thus not subject to individual adjustment; and the four attached external heat exchangers 18, 19, 20, and 21 for which heat exchange is individually adjustable by acting on the flow rates of the solid matter feeding them via 46, 47, 48, and 49, thus making it possible to adjust the operating temperature of the reactor at all loads and optionally to adjust in parallel heat exchange with one or two external fluids.

It should also be observed that the disposition of the internal bubbling beds 22 and 23 and of the external heat exchangers 18, 19, 20, and 21 as shown in FIGS. 1 to 6 may be varied. Other, non-limiting examples acting on the number or the relative disposition of these devices are shown in FIGS. 7, 8, and 9.

Figure 7A:
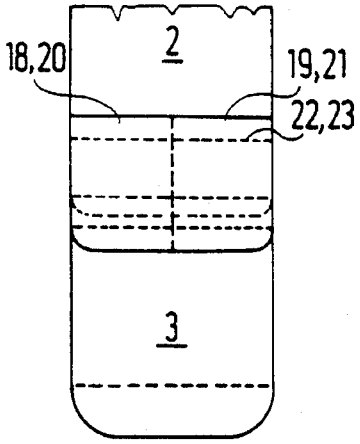
FIGS. 7A, 7B, and 7C are diagrams showing a variant reactor of the invention, respectively in side view, in plan view, and in front view.
Figure 7B:
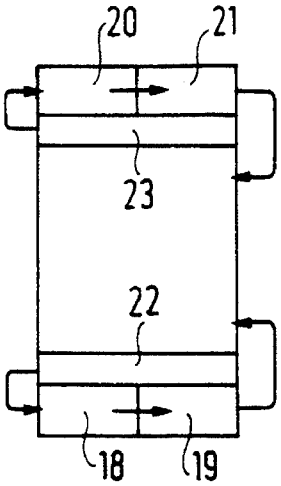
Figure 7C:
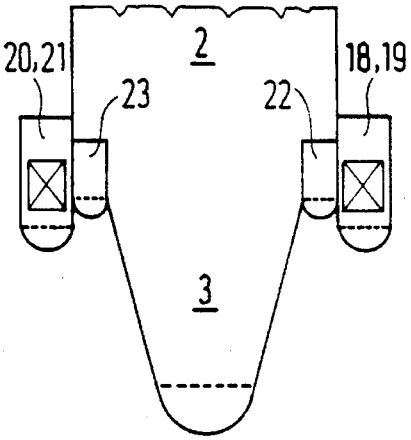
Figure 8A:
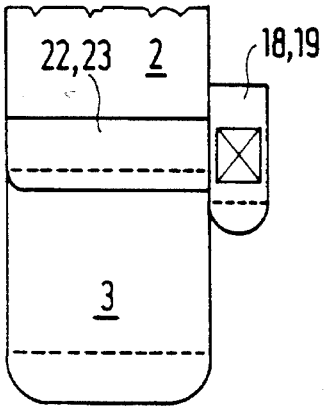
FIGS. 8A, 8B, and 8C are diagrams showing a second variant of the reactor of the invention.
Figure 8B:
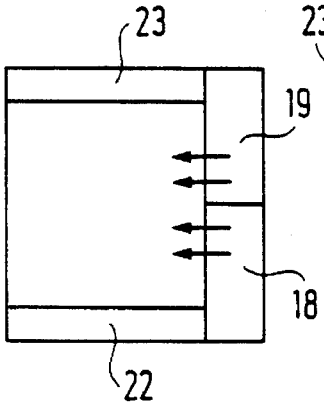
Figure 8C:
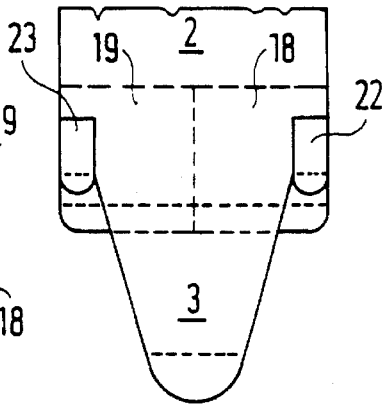
Figure 9A:
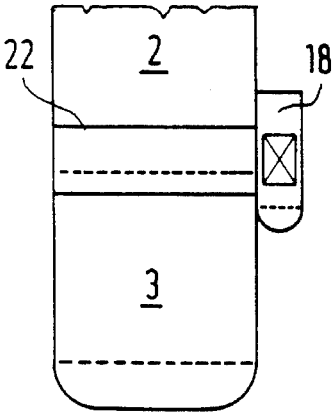
FIGS. 9A, 9B, and 9C are diagrams showing a third variant of the reactor of the invention.
Figure 9B:
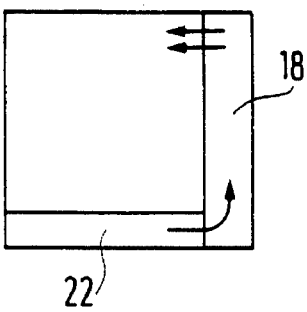
Figure 9C:
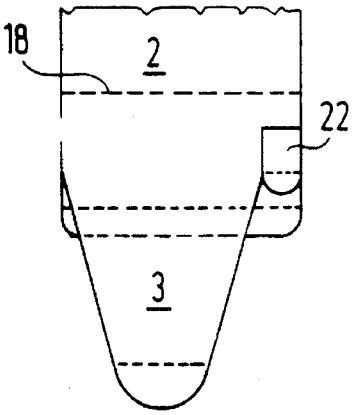

In FIG. 7, the internal bubbling beds 22 and 23 and the external heat exchangers 18, 19, 20, and 21 are on the same walls; in FIG. 8 the external heat exchangers 18 and 19 are installed on one side wall only, with the internal bubbling beds 22 and 23 continuing to be installed on the front and rear walls; and in FIG. 9, there is only one external heat exchanger 18 which is installed on one of the side walls, and an internal bubbling bed 22 installed on the front wall.

The main advantage of this novel circulating fluidized bed reactor is the possibility due to the simplification of the connections, of installing the external heat exchangers 18, 19, 20, and 21 at a level such that the lower zone 3 of the reactor is released both from said external heat exchangers 18, 19, 20, and 21 and from their connections with the reactor, thereby leaving it fully available for designing and installing (primary and secondary) air circuits that relate to combustion and the return of solid matter from the cyclones 7 installed on the outlet from the reactor. This characteristic makes extrapolation to high powers possible, as shown in the following example.

A high power circulating fluidized bed reactor (300 MWe) is shown in FIGS. 10, 11, 12, and 13.

The heat exchange power is about 750 MW, comprising 450 MW for heat exchange with the internal tube walls of the reactor (125 MW) and the external heat exchangers (325 MW), and 300 MW for the heat exchangers situated inside the envelope 14 and the air heaters 15.

The lower zone 3 is divided into two portions 3A and 3B, thereby enabling the width between the side walls 24 and 25 to be divided into two. Width is a limiting factor on the penetration of the jets of secondary air 13 required for achieving good combustion.

The primary air circuits 12, the secondary air circuits 13, and the returns 9 of solid matter from the cyclones 7 are disposed in optimum manner around the lower portions 3A and 3B by means of an installation that complies with the explanations in the paragraphs above concerning two internal bubbling beds 22 and 23 installed against the left and right side walls 24 and 25 of the reactor, and four external heat exchangers 18, 19, 20, and 21 attached to the outside of the reactor on its front and rear walls 34 and 35, and fed with solid matter via fluidized ducts 46, 47, 48, and 49.

Each of the four heat exchangers 18, 19, 20, and 21 is split into two (18A, 18B, etc.) by a respective mid-partition 50, 51, 52, and 53 which is open at the top to allow solid matter to feed the downstream portion by overflowing.

Figure 11:
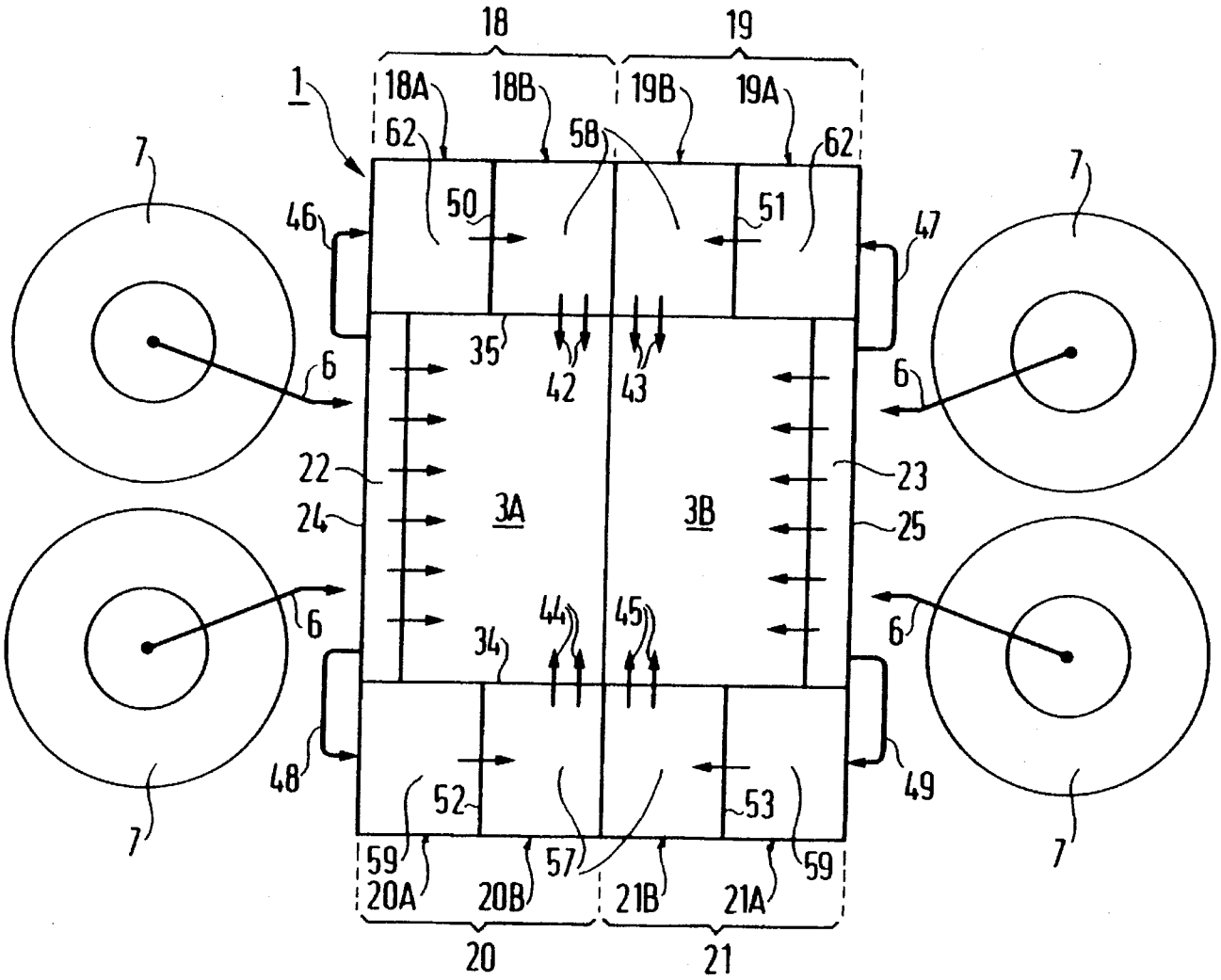
FIG. 11 is a diagrammatic plan view of the FIG. 10 reactor.
Figure 12:
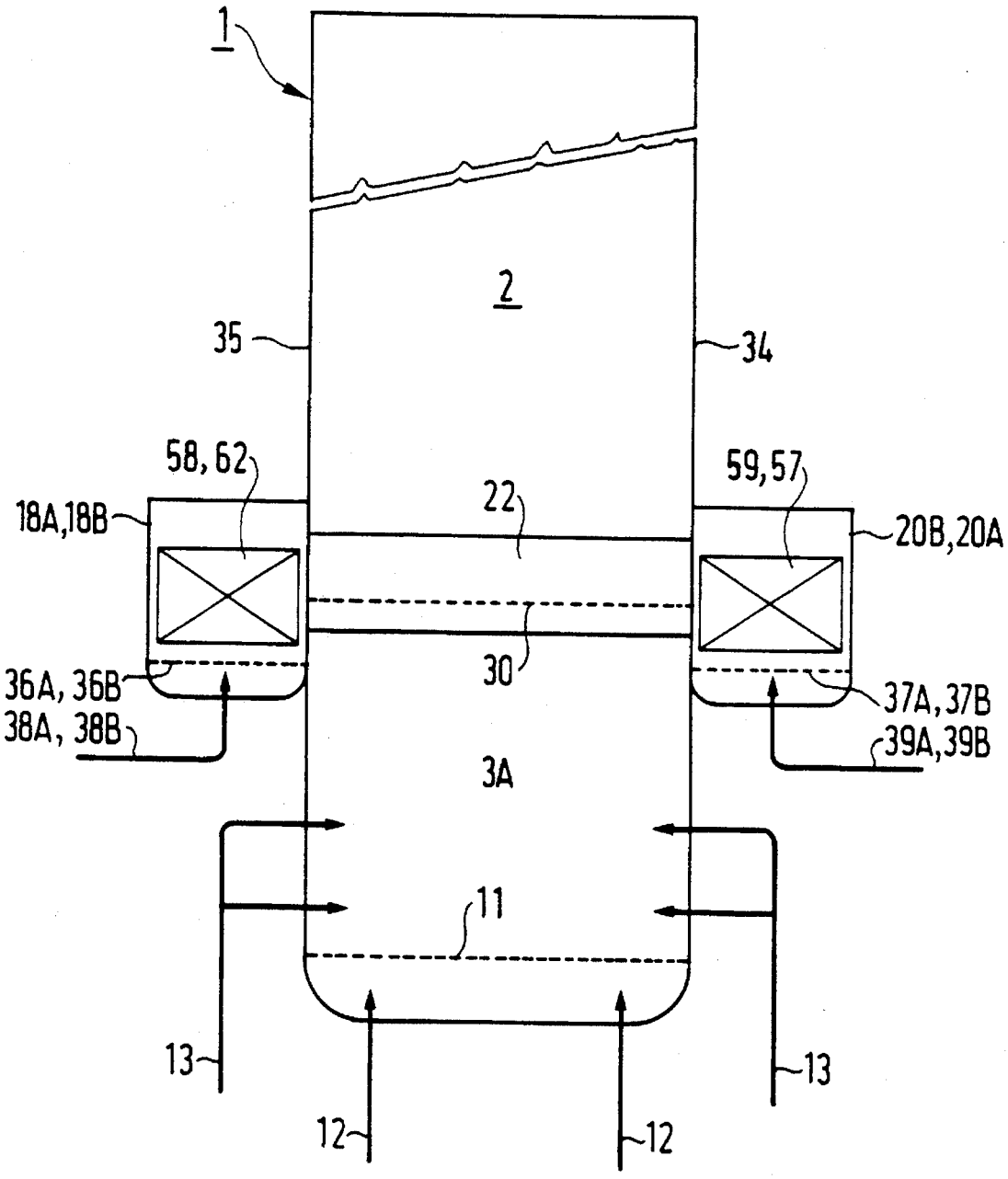
FIG. 12 is a diagrammatic side view of the FIG. 10 reactor.
Figure 13:
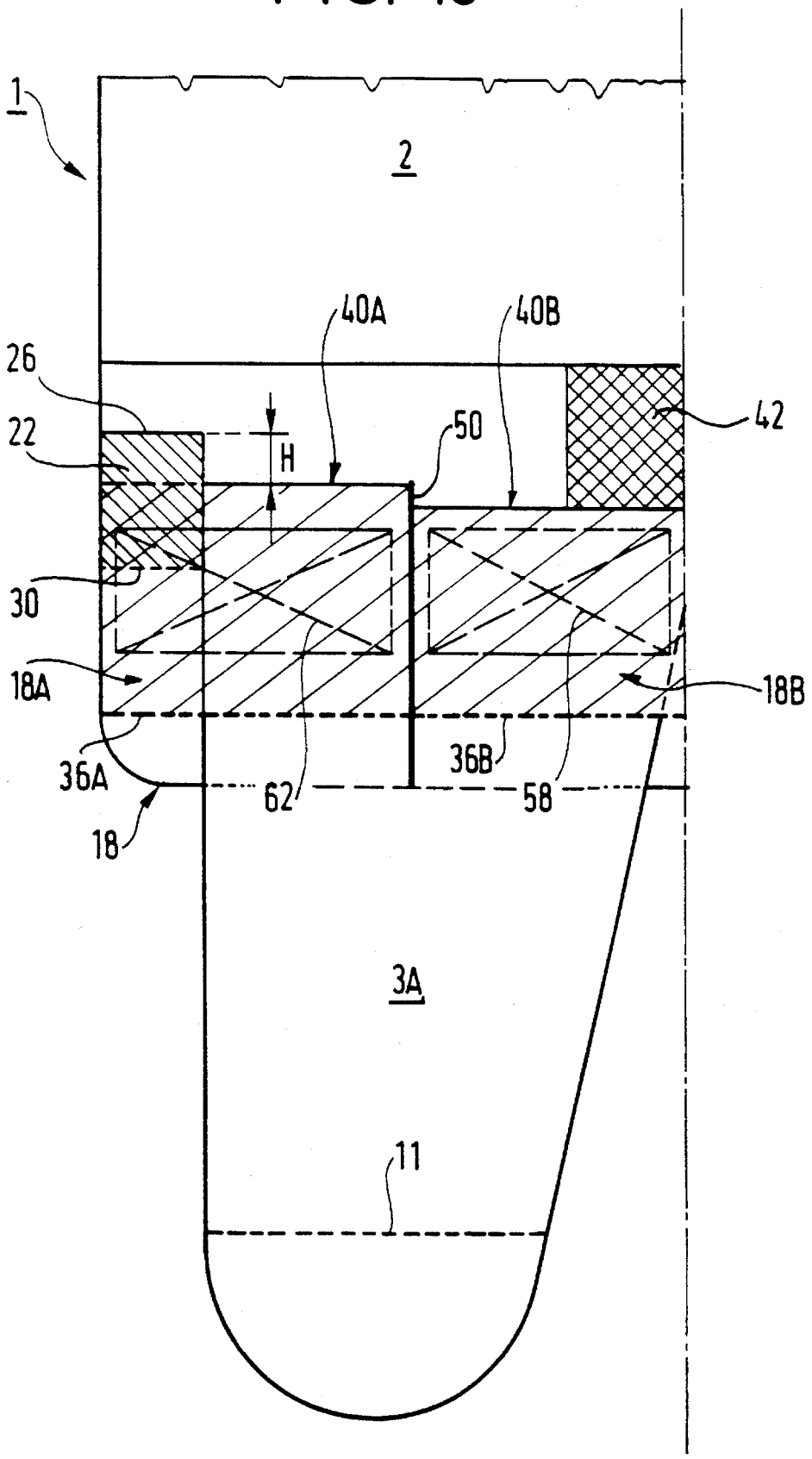
FIG. 13 is a fragmentary diagrammatic view of the FIG. 10 reactor, shown on a larger scale.

Thus, as shown in FIGS. 11 and 13, the heat exchanger 18 is split into two portions 18A and 18B, the portion 18A being fed from the internal bubbling bed 22 via the duct 46, and the portion 18B being fed by overflow passing over the vertical partition 50 whose top edge corresponds to the level 40A (FIG. 13), with solid matter falling into the bottom portion 3A of the reactor through the window 42 whose bottom level 40B fixes the height of the fluidized bed in the portion 18B.

The internal bubbling beds 22 and 23 are fitted with fluidization grids 30 and 31 through which inert fluidization gases are blown by means 32 and 33. The external heat exchangers such as 18A, 18B, 20A, and 20B are fitted with fluidization grids such as 36A, 36B, 37A, and 37B through which fluidization air is blown by means such as 38A, 38B, 39A, 39B, etc.

Figure 14:
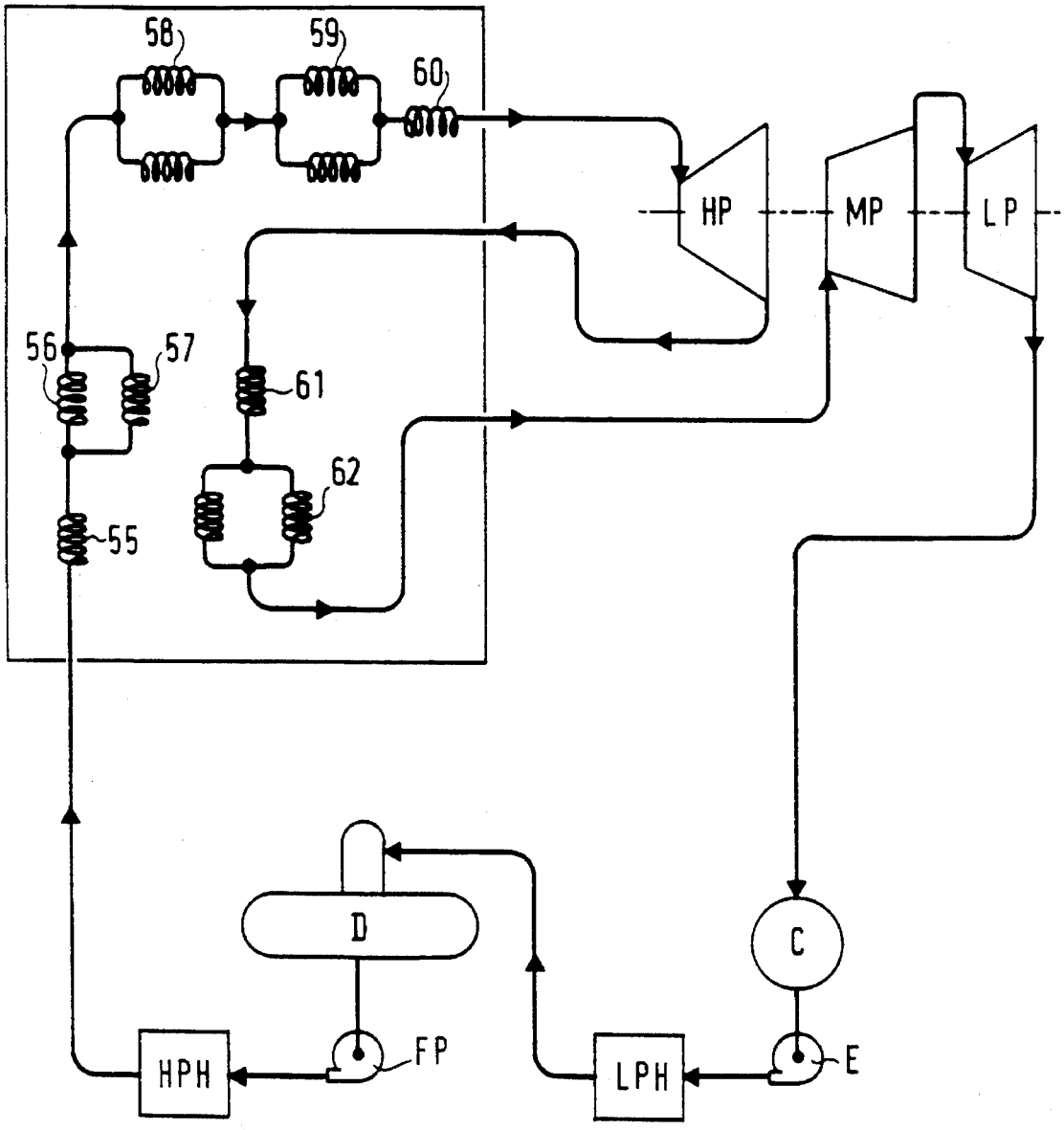
FIG. 14 is a water-steam diagram for an installation of which the FIG. 10 reactor forms a part.

By way of example, this 300 MW electrical circulating fluidized bed reactor is applied to a subcritical steam fossil fuel power station whose watersteam diagram is given in FIG. 14:

The turbine room includes a three-shell turbine having a high pressure shell (HP), a medium pressure shell (MP), and a low pressure shell (LP), a condenser C receiving the low pressure steam from the shell LP, an extractor pump E, low pressure water heaters LPH receiving the water extracted by the pump E, a deaerator D, feed pumps FP, and high pressure heaters HPH.

The circulating fluidized bed boiler comprises an economizer 55 fed with water from the high pressure heaters HPH, two steam evaporators 56 and 57 operating in parallel, a low temperature superheater 58, a medium temperature superheater 59, and a high temperature superheater 60, together with a low temperature reheater 61 and a high temperature reheater 62. The high temperature superheater 60 delivers high pressure steam to the HP shell. That shell returns steam to the reheaters 61 and 62 which deliver medium pressure steam to the shell MP.

Figure 10:
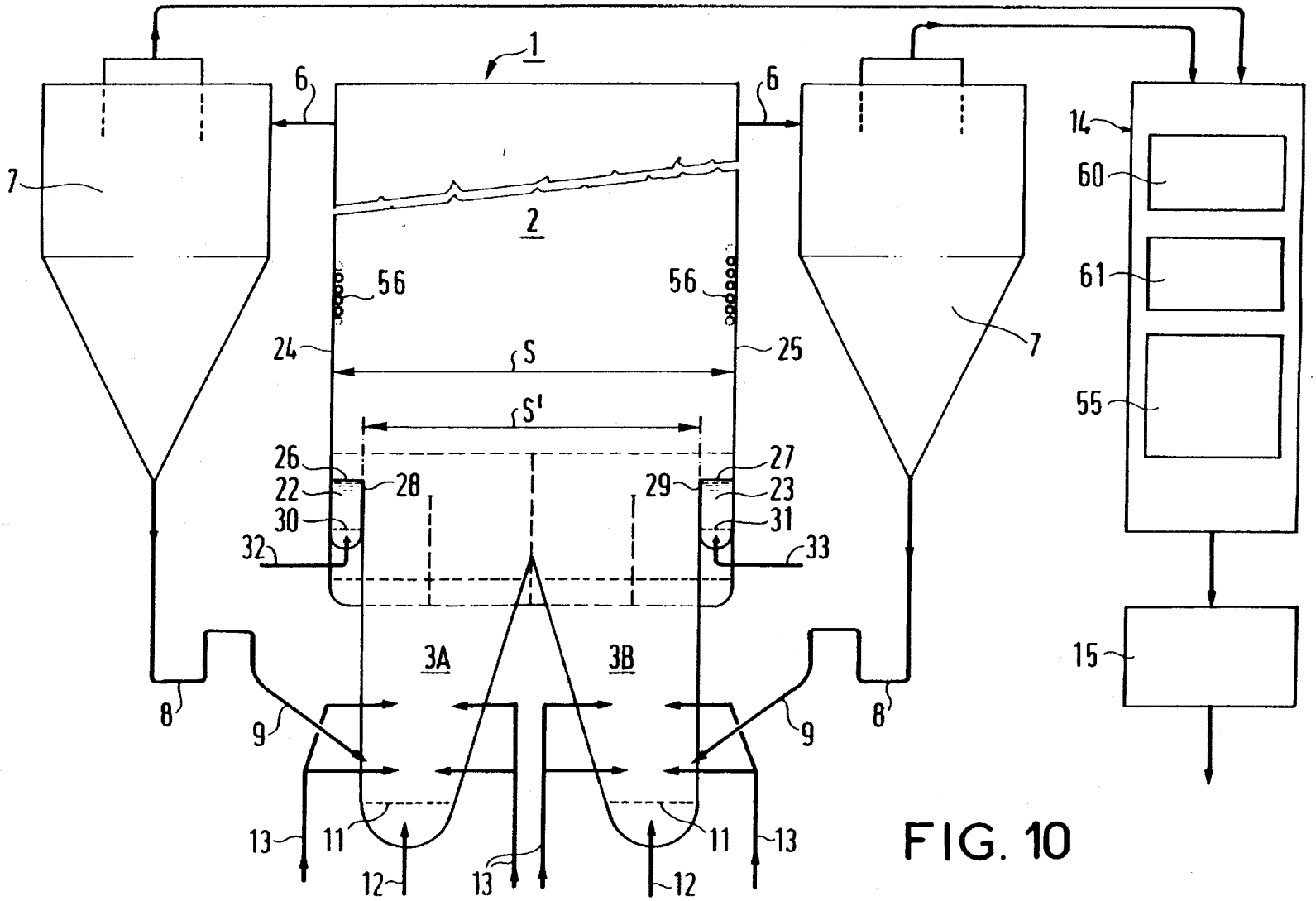
FIG. 10 is a front view diagram of a variant reactor of the invention adapted to high power and including a lower zone that is divided into two portions.

FIG. 10 shows the positions of the evaporator 56 constituted by the tubes 4 disposed as shown in FIG. 1 against the inside walls of the reactor, and the positions of the high temperature superheater 60, of the low temperature reheater 61, and of the economizer 55 in the envelope 14.

FIG. 11 shows the disposition of the devices in the external heat exchangers 18, 19, 20, and 21 attached at an intermediate height up the reactor: the medium temperature superheaters 59 and the evaporators 57 are disposed respectively in the external heat exchangers 20A & 21A and 20B & 21B, while the high temperature reheaters 62 and the low temperature superheaters 58 are respectively disposed in the external heat exchangers 18A & 19A and 18B & 19B.

Heat exchange between solid matter and steam in the external heat exchangers 20 and 21 serves to control the temperature of the reactor, e.g. to 850° C. Heat exchange between solid matter and steam in the heat exchangers 18 and 19 serves to control the temperature of the reheated steam to a selected reference value, e.g. 565° C.

FIG. 10 shows clearly that the entire lower zone of the reactor is split into two portions, each of which can be fitted with its own combustion circuits without any constraints due to the external heat exchangers, and in particular each of which can be fitted with two or more levels of secondary air on its eight walls together with return lines from four cyclones on its side walls.

Each lower portion 3A or 3B thus corresponds to a circulating fluidized bed reactor having a power of 150 MWe.

The above example corresponds to a power of 300 MWe, but a reactor of the invention may be implemented to have a power that may be greater than 600 MW electrical, for example, by increasing the length of the side walls and the surface area of the external heat exchangers on the front and rear walls.

We claim:

1. A circulating fluidized bed reactor, comprising:

an enclosure (1) defining an interior space having a lower zone (3) extending from a bottom of said enclosure to an intermediate level in said interior space, said lower zone having a first cross-sectional area at said intermediate level and having a primary air inlet (12) near said bottom, a fluidization grid (11) above said air inlet and a secondary air inlet (13) above said fluidization grid, and an upper zone (2) extending from said intermediate level to a top of said enclosure and including solid matter exhausting means (6) for exhausting solid matter to a cyclone (7), said upper zone having a second cross-sectional area at said intermediate level, with a ratio of said second cross-sectional area to said first cross-sectional area at said intermediate level being in the range of 1.05 to 2;

at least one internal bubbling bed (22) disposed in said interior space with its top substantially at said intermediate level, said internal bubbling bed including a further fluidization grid and a fluidization gas injection means beneath the further fluidization grid;

means (10) for admitting fuel to said interior space;

solid return means (9) for returning solid matter from the cyclone to said interior space;

at least one external chamber (18) adjacent to and outside of said enclosure, disposed above the secondary air inlet (13) of said lower zone and above a point at which said solid return means (9) returns solid matter to said lower zone, said external chamber (18) comprising at least one external heat exchanger having means for exchanging heat with an external fluid to be heated, said at least one external heat exchanger of said external chamber controlling an operating temperature of the reactor;

solid matter feed means (46) for feeding solid matter from said internal bubbling bed into said external chamber;

means (28) for discharging solid matter from said internal bubbling bed into said lower zone;

means (42) for discharging solid matter from said external chamber to said lower zone, said means (42) for discharging solid matter comprising an aperture which couples said external chamber to said interior space, said aperture being disposed in said enclosure at a level below the level of solid matter in said internal bubbling bed, whereby excess solid matter accumulating in said external chamber is permitted to overflow into said lower zone through said aperture; and means for controlling the flow of solid matter from said internal bubbling bed to said at least one external heat exchanger, wherein said at least one external heat exchanger is disposed at least partially below said internal bubbling bed, with a level of solid matter in said at least one external heat exchanger being below the level of solid matter in said internal bubbling bed, and further wherein the amount of solid matter falling into said internal bubbling bed is greater than the amount of solid matter supplied from said internal bubbling bed to said at least one external heat exchanger, whereby solid matter overflows from said internal bubbling bed into said lower zone.

2. The reactor according to claim 1, further comprising cooling tubes disposed adjacent said enclosure for exchanging heat from said enclosure with an external fluid to be heated.

3. The reactor according to claim 1, wherein the velocity of fluidization gases within said interior space, including the interior space immediately above said intermediate level, is always at least 2.5 meters per second.

4. The reactor according to claim 1, wherein said internal bubbling bed collects solid matter falling along the walls of said enclosure in said upper zone as well as solid matter due to a decrease in a velocity of lower zone gases going past said internal bubbling bed.

5. The reactor according to claim 1, wherein said at least one external heat exchanger includes a still further fluidization grid and air injection means beneath the still further fluidization grid.

6. The reactor according to claim 5, wherein the at least one external heat exchanger includes at least one bubbling bed larger than said internal bubbling bed.

7. The reactor according to claim 1, further comprising a fossil fuel power station in combination with said reactor, the power station including a boiler containing reheated steam, wherein said at least one external heat exchanger of said external chamber controls a temperature of the reheated steam.

8. The reactor according to claim 1, wherein said fluidization gas injection means injects inert gases into said internal bed.

9. The reactor according to claim 8, wherein said internal bubbling bed does not include any heat exchange for heat exchange with an external fluid.

10. The reactor according to claim 1, wherein a cross sectional area of said upper zone is substantially constant between said intermediate point and said solid matter exhausting means.

* * * * *